US006372702B1

(12) United States Patent
Chiou et al.

(10) Patent No.: US 6,372,702 B1
(45) Date of Patent: Apr. 16, 2002

(54) DISHWASHING COMPOSITION FOR COATING DISHWARE WITH A SILICON SURFACTANT

(75) Inventors: Yu-Min Catherine Chiou, Saddle Brook, NJ (US); Bingham Scott Jaynes, New City, NY (US); Dennis Stephen Murphy, Wyckoff; Deborah Sue Rick, Dumont, both of NJ (US)

(73) Assignee: Diversey Lever, Inc., Plymouth, MI (US)

( * ) Notice: Subject to any disclaimer, the term of this patent is extended or adjusted under 35 U.S.C. 154(b) by 0 days.

(21) Appl. No.: 09/508,000

(22) Filed: Feb. 22, 2000

(51) Int. Cl.[7] ..... C11D 9/36

(52) U.S. Cl. ..... 510/222; 510/220; 510/221; 510/224; 510/227; 510/228; 510/466; 510/514

(58) Field of Search ..... 510/220, 221, 510/222, 224, 466, 514, 227, 228

(56) References Cited

U.S. PATENT DOCUMENTS 4,105,573 A * 8/1978 Jacobsen ..... 252/99
4,136,045 A * 1/1979 Gault et al. ..... 252/135
4,878,951 A * 11/1989 Pochard et al. ..... 134/22.17
5,603,776 A * 2/1997 Lentsch et al. ..... 134/25.2
5,880,088 A 3/1999 Lentsch et al. ..... 510/514
5,880,089 A 3/1999 Lentsch et al. ..... 510/514
6,022,844 A * 2/2000 Baillely et al. ..... 510/504

FOREIGN PATENT DOCUMENTS

EP 351185 * 1/1990
WO 98/30662 7/1998

* cited by examiner

*Primary Examiner*—Charles Boyer
(74) *Attorney, Agent, or Firm*—Edward A. Squillante, Jr.

(57) ABSTRACT

A dishwashing composition having a silicon comprising surfactant, a dialkyl ester of an alpha, omega-alkyl dicarboxylic acid surfactant or both is described. The dishwashing composition unexpectedly results in dishware that does display improved starch soil removal and does not display starch buildup after multiple washes.

14 Claims, No Drawings

DISHWASHING COMPOSITION FOR COATING DISHWARE WITH A SILICON SURFACTANT

FIELD OF THE INVENTION

This invention is directed to a dishwashing composition, and a method for improving starchy soil removal and preventing starch build-up on articles being cleaned. More particularly, the invention is directed to a superior dishwashing composition that has a silicon-comprising surfactant, a dialkyl ester of an alpha, omega-alkyl dicarboxylic acid surfactant wherein the alkyl chain of the dicarboxylic acid is functionalized with at least one hydrophilic group, or both. The dishwashing composition unexpectedly results in dishware that does display improved starchy soil removal and does not display starch build-up after multiple washing cycles.

BACKGROUND OF THE INVENTION

Traditional industrial and domestic dishwashing systems rely on a combination of high alkalinity detergent washes and chlorine bleach for cleaning and sanitizing dishware. Such systems perform well on bleachable stains; however, they tend to be deficient in removing starchy soils like those often found on dishware in domestic kitchens, hospitals, cafeterias, catering industries and the like.

Other attempts have been made to create dishwashing systems that are effective at handling starchy soils. These systems typically employ commercially available enzymes that break down the starchy soil in the various cycles of the dishwashing systems they are employed in. The enzymes used in systems for treating starchy soils on dishware are generally not limited and include those that typically break or hydrolyze the $\alpha$-1,4-glycosidic linkages of the starch backbone.

In addition to being sanitized, it is very desirable for dishware exiting dishwashing systems to be dry with a glossy finish. These characteristics are often achieved by employing a rinse aid composition in the final rinse step of the dishwashing system.

Unfortunately, however, it has been discovered that conventional rinse aid and detergent washes typically result in dishware with non-appealing characteristics. This is true because conventional detergent washes are not always effective at removing starchy soils from the dishware they are employed to clean. Also, studies indicate that conventional rinse aid compositions can result in poor starch removal on dishware subject to as little as one cleaning cycle.

It is of increasing interest to develop dishwashing compositions that maintain their conventional characteristics and do not adversely interfere with the cleaning process of a dishwashing system. Also, it is of increasing interest to develop methods that induce starchy soil removal and prevent starch build-up on articles, such as dishware, being cleaned. The inventions described herein, therefore, are directed to a superior dishwashing composition, and a method for improving starchy soil removal and preventing starch build-up on articles. Such inventions are achieved by employing a dishwashing composition that has a silicon-comprising surfactant, a dialkyl ester of an alpha, omega-alkyl dicarboxylic acid surfactant wherein the alkyl chain of the dicarboxylic acid is functionalized with at least one hydrophilic group, or both.

DESCRIPTION OF BACKGROUND REFERENCES

Methods have been disclosed for cleaning plasticware. In U.S. Pat. No. 5,603,776, plasticware is cleaned by subjecting the same to an alkaline aqueous cleaning agent and an aqueous rinse comprising nonionic surfactant, fluorinated hydrocarbon surfactant and polyalkylene oxide-modified polydimethylsiloxane.

Further, rinse aid compositions that comprise a modified polydimethylsiloxane have been disclosed. In U.S. Pat. No. 5,880,089, a rinse aid composition with a modified polydimethylsiloxane or a polybetaine-modified polysiloxane, a fluorinated hydrocarbon nonionic surfactant and a nonionic block copolymer of ethylene oxide and propylene oxide is disclosed.

Still further, in U.S. Pat. No. 5,880,088, rinse aid compositions that comprise a polyether or polybetaine polysiloxane copolymer, hydrotrope and nonionic block copolymer of ethylene oxide and propylene oxide are disclosed.

Also, in WO 98/30662, a detergent composition with a source of alkalinity and a blend of nonionic alkoxylated surfactant and nonionic alkoxylated silicone surfactant is described.

The prevention of, for example, starchy soil build-up, and starchy soil removal on articles being cleaned has not been addressed in the above described-references. The present inventions, therefore, are patentably distinguishable from the above-described since, among other reasons, they are directed to starchy soil removal and the prevention of starch build-up on articles being cleaned, particularly in a dishwashing system. Moreover, the present inventions display superior results without requiring the use of polybetaine modified polysiloxanes; fluorinated hydrocarbons; sorbitan fatty acid esters; nonionic, non-silicone comprising alkoxylated surfactants; and nonionic block copolymers of ethylene oxide and propylene oxide. Particularly, a nonionic surfactant with an ethylene oxide group is not required when the silicon comprising surfactant is nonionic.

SUMMARY OF THE INVENTION

In a first embodiment, the invention is directed to a dishwashing composition comprising:

at least one member selected from the group consisting of a silicon comprising surfactant and a dialkyl ester of an alpha, omega-alkyl dicarboxylic acid surfactant wherein the alkyl chain of the dicarboxylic acid is functionalized with at least one hydrophilic group, or both wherein the dishwashing composition prevents starch build-up and improves soil removal on articles being washed.

In a second embodiment, the invention is directed to a method for using the dishwashing composition described in the first embodiment of this invention.

In a third embodiment, the invention is directed to an optional pre-coating composition that enhances soil removal and prevents starch build-up on articles being cleaned, the pre-coating composition comprising at least one member selected from the group consisting of a silicon comprising surfactant and a dialkyl ester of an alpha, omega-alkyl dicarboxylic acid surfactant wherein the alkyl chain of the dicarboxylic acid is functionalized with at least one hydrophilic group.

As used herein, dishwashing composition is defined to mean a detergent wash or a rinse aid that may be used in a domestic or industrial dishwashing machine, the detergent wash or rinse aid being a block, tablet, powder, gel or liquid prior to being introduced to the dishwashing system. Also, the silicon comprising surfactant and the dialkyl ester of an alpha, omega-alkyl dicarboxylic acid surfactant that may be used in the dishwashing composition of this invention may herein be referred to as the soil removal surfactants.

DETAILED DESCRIPTION OF THE PREFERRED EMBODIMENTS

There generally is no limitation with respect to the silicon comprising surfactant and the dialkyl ester of an alpha, omega-alkyl dicarboxylic acid surfactant that may be used in this invention other than that the surfactants may be employed in a dishwashing composition.

Such silicon comprising surfactants are typically siloxanes. The preferred siloxane which may be used in this invention is one having the formula:

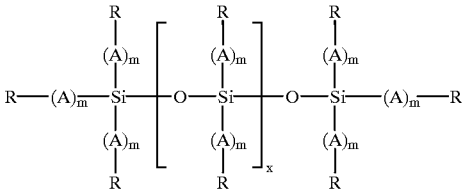

wherein each A is independently a hydrocarbon bridging group; each R is independently a $C_{1-10}$ alkyl, aryl, cationic group, anionic group, polyalkylene oxide; x is an integer from about 1 to about 250; and each m is 0 or 1, with the proviso that at least one R group is hydrophilic and when R is hydrophilic m is 1.

Typical cationic groups include ammonium, quaternary nitrogen, imidazoline and pyridinium compounds. Typical anionic groups include a sulfate, sulfonate and carboxylate.

The preferred alkyl used in this invention is a methyl, and the preferred polyalkylene oxide is an ethoxylate, propoxylate or copolymer prepared therefrom. The preferred hydrocarbon bridging groups that may be used in this invention include at least one having the formula:

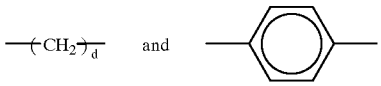

wherein d is an integer from about 1 to about 10.

The molecular weight of the silicon comprising surfactants that may be used in this invention is typically from about 250 to about 200,000, preferably, from about 300 to about 150,000, and most preferably, from about 500 to about 100,000, including all ranges subsumed therein.

The silicon comprising surfactants which may be used in this invention can be made for example, by equilibration of the appropriate portions of end capped and monomer units according to the reaction: $MM+D_x \rightarrow MD_xM$. Such a reaction is generally known as an equilibration reaction, and is catalyzed by an acid or a base. Similar reactions are depicted in *Silicone Surfactants*, as edited by Randal Hill, Marcel Dekker (Vol. 86 1999), the disclosure of which is incorporated herein by reference. Other similar descriptions of the synthesis of similar surfactants may be found in U.S. Pat. Nos. 3,931,047 and 5,410,007, the disclosures of which are incorporated herein by reference. Such surfactants are often commercially available by Witco Corporation, Goldschmidt Chemical Corporation and the Dow Corning Corporation.

The most preferred silicon comprising surfactants used in this invention are those which are sold by Witco Corporation under the name Silwet L-77, L-7600, L-7602, L-7604 and L-7210.

The dialkyl ester of an alpha, omega-alkyl dicarboxylic acid surfactant which may be used in this invention is one which has the formula:

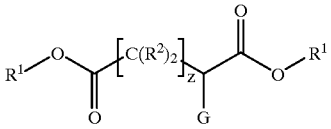

wherein each $R^1$ is independently a $C_{1-10}$ alkyl; each $R^2$ is independently a hydrogen, $C_{1-10}$ alkyl or aryl; G is a hydrophilic group wherein the hydrophilic group is a cationic group selected from the group consisting of an ammonium, quaternary nitrogen, imidazoline or pyridinium compound, or an anionic group selected from the group consisting of a sulfate, sulfonate, phosphate and carboxylate, and z is an integer from about 1 to about 15.

Such surfactants are typically made by the methods described in U.S. Pat. Nos. 2,028,091 and 2,176,423, the disclosures of which are incorporated herein by reference. The preferred surfactant in this category is Aerosol OT (sulfobutanedioic acid 1,4-bis-(2-ethylhexyl) ester sodium salt) as made commercially available by Cytec Industries, Inc.

Where applicable, the counter ions that may be used in this invention include, for example, $Br^-$, $I^-$, $Cl^-$, $SO_4^{2-}$, $OH^-$, $HSO_4^-$, alkali metal, alkaline earth metal, $NH_4^+$ and the like.

When the dishwashing composition used with the soil removal surfactants of this invention is a detergent wash, such a wash typically comprises at least one compound capable of causing starch degradation. The compound which is capable of causing starch degradation is only limited to the extent that it is a compound which is capable of hydrolyzing the glycosidic linkages of starch or breaking any of the $Sp^3$ bonds of the glucose monomer that make up the starch backbone. Typically, the compounds which are used for starch degradation in the detergent washes which may be employed in this invention are generally classified as enzymes, caustic agents and oxidizing agents, whereby the oxidizing agents may be used with catalysts. The enzymes which may be used for starch degradation in the detergent wash is used in this invention include α-amylase enzymes such as those made commercially available from Novo Nordisk and Genencor and sold, for example, under the names of Termamyl®, Duramyl® and Purastar OxAm. When the detergent wash is prepared with an enzyme, such as amylase, the amount of enzyme typically used in a formulation is such that the final use composition of said enzyme component has an enzyme activity from about 10 to about $10^8$ maltose units (MU) per kilogram, and preferably from about $10^2$ to about $10^6$ MU per kilogram, and preferably, from about $10^2$ to about $10^4$ MU per kilogram. The enzyme activity as referred to herein can be determined by the method as described by P. Bernfeld, "*Method of Enzymology*", Vol. 1 (1955), page 149, the disclosure of which is incorporated herein by reference. Other additives which may be employed in the enzymatic detergent washes which may be used in this invention include disilicates, such as sodium disilicate, soda ash, triphosphates like sodium triphosphates, chelators like nitriloacetic acid, polycarboxyates such as sodium polycarboxylate, water, fatty acid alkoxylates and alcohol phosphate ester-type defoaming agents. A more detailed description of the detergent washes (which comprise enzymes) that may be used in this invention are described in U.S. Pat. Nos. 5,695,575, 5,741,767 and 5,877,134, the disclosures of which are incorporated herein by reference.

Detergent washes using caustic (e.g., NaOH, KOH) that may be used with the soil removal surfactant(s) of this invention are known and described in U.S. Pat. No. 4,774,014, the disclosure of which is incorporated herein by reference. Typically, such detergent washes comprise from about 10% to about 75% by weight caustic, based on total weight of the detergent wash and including all ranges subsumed therein.

The detergent washes that utilize oxidizing agents that may employ the soil removal surfactants described in this invention include washes with hydrogen peroxide, chlorine bleach and organo peroxyacids. Such washes are described in U.S. Pat. No. 5,741,767, the disclosure of which is incorporated herein by reference.

The catalysts which may be used in the detergent washes that may employ the soil removal surfactant described in this invention include those which may be broadly classified as metal containing catalysts that enhance oxidizing agents in breaking $Sp^3$ bonds of a glucose ring. Illustrative examples of the preferred metal containing catalysts include those comprising manganese, iron, cobalt, titanium, molybdenum, nickel, chronium, copper, ruthenium, tungsten, silver and mixtures thereof. A more detailed description of such catalysts may be found in commonly assigned patent application, U.S. Ser. No. 09/344,013, the disclosure of which is incorporated herein by reference.

When the dishwashing composition of this invention is a rinse aid (which comprises the soil removal surfactant of this invention), conventional rinse aid additives may be used, including hydroxy acids, alcohols, hydrotropes, preservatives and water. The hydroxy acids which may be employed in the rinse aid of this invention include those that are naturally occurring and commercially available. Often, when preparing the rinse aid compositions of this invention, about 0.0% to about 50.0%, and preferably, from about 5.0% to about 40.0%, and most preferably, from about 10.0% to about 30.0% by weight of hydroxy acid is employed based on total weight of the rinse aid composition, including all ranges subsumed therein. An illustrative list of the hydroxy acids which may be used in this invention include malic acid, lactic acid, citric acid, glycolic acid, tartaric acid and the like. Citric acid, however, is often the most preferred hydroxy acid.

The alcohols which may be employed in this invention include, for example, $C_1$–$C_8$ primary, secondary or tertiary alcohols. Such alcohols are commercially available. Isopropanol, however, is often the most preferred alcohol. When alcohols are employed in rinse aid compositions, the rinse aid compositions often employ from about 0.0% to about 20.0%, and preferably from about 0.5% to about 10.0% and most preferably from about 1.0% to about 5.0% by weight alcohol based on total weight of the rinse aid composition.

The hydrotropes which may be employed in this invention are limited only to the extent that they enhance the solubility of the surfactants in the rinse aid composition of this invention. The hydrotropes which may be used in this invention are those which are commercially available, and an illustrative list includes sodium xylene sulfonate, sodium cumene sulfonate, hexylene glycol, propylene glycol, dihexyl sodium sulfonate and low molecular weight sulfates. Other useful hydrotropes which may be employed in this invention include those described in U.S. Pat. Nos. 3,563,901 and 4,443,270, the disclosures of which are incorporated herein by reference.

When hydrotropes are employed in the rinse aid composition of this invention, they often represent from about 0.1% to about 20.0%, and preferably, from about 2.0% to about 15.0%, and most preferably, from about 5.0% to about 12.0% by weight of the total weight of the rinse aid composition, including all ranges subsumed therein.

The preservatives which may be used in the rinse aid composition of this invention include ascorbic acid, erythorbic acid, sorbic acid, thiodipropionic acid, ascorbyl palmitate, butylated hydroxyamisol, butylated hydroxytoluene, calcium ascorbate, calcium sorbate, dilauryl thiodipropionate, potassium bisulfate, potassium metabisulfate, potassium sorbate, sodium ascorbate, sodium bisulfate, sodium meta bisulfite, sodium sorbate, sodium sulfite, sulfur dioxide, tocophenols and Group IA and IIA salts, with potassium chloride being preferred. When preservatives are used in the rinse aid composition of this invention, they typically make up about 0.01% to about 0.2%, and preferably, from about 0.02% to about 0.1%, and most preferably, from about 0.04% to about 0.8% by weight of the total rinse aid composition, including all ranges subsumed therein.

When water is employed in the dishwashing composition of this invention, it generally is the solvent making up the balance of the composition.

The dishwashing composition of this invention may be prepared via any of the art recognized techniques. Essentially, the components (e.g., surfactant, water) of the composition are, for example, mixed, stirred or agitated. The detergent composition of this invention may be made at ambient temperature, atmospheric pressure or at any pressure or temperature variations which may result in the detergent compositions of this invention. The addition of the components is not limited to any particular order, with the proviso that the resulting composition is one which may be employed as a detergent composition that prevents starch build-up in cleaning systems.

The amount of soil removal surfactant employed in the dishwashing composition (i.e., detergent wash or rinse aid or both) of this invention is limited only to the extent that the amount employed results in improved starchy soil removal.

Typically, from about 0.5% to about 30.0%, and preferably, from about 0.75% to about 10.0%, and most preferably, from about 1.0% to about 2.0% of the dishwashing composition is soil removal surfactant, based on total weight of the dishwashing composition, including all ranges subsumed therein.

When conducting the method for preventing starch build-up on dishware in this invention, the method comprises the steps of:

a) contacting dishware soiled with starch with the dishwashing composition of this invention; and b) removing the dishware from the dishwashing composition.

When conducting the method of this invention, the dishware being cleaned (e.g., knives, pots, pans, forks, spoons, glasses, mugs, cups, china, dishes or plastic kitchen utensils) in, for example, a dishwasher, is often subjected to at least one cycle selected from the group consisting of a presoak cycle, a wash cycle and a rinse cycle, followed by a final rinse cycle.

When the wash cycle utilizes the dishwashing composition of this invention (e.g., detergent wash), the wash cycle is typically run from about 5.0 seconds to about 15 minutes, and preferably, from about 10 seconds to about 12 minutes, and most preferably, from about 30 seconds to about 10 minutes in an industrial system, including all ranges subsumed therein.

In a domestic system, the wash cycle is typically run from about 2 minutes to about 45 minutes, and preferably, from about 5 minutes to about 35 minutes, and most preferably, from about 8 minutes to about 30 minutes, including all ranges subsumed therein.

The final rinse cycle when using the dishwashing composition (e.g., rinse aid) of this invention is typically run for about 5 to about 90 seconds in industrial systems and for about 2 minutes to about 25 minutes in domestic systems, and preferably, for about 10 seconds to about 60 seconds in industrial systems and about 5 minutes to about 20 minutes in domestic systems, and most preferably, from about 7 seconds to about 12 seconds in industrial systems and from about 10 minutes to about 15 minutes in domestic systems, including all ranges subsumed therein.

The temperature of the wash cycle (in industrial and domestic systems) is typically from about ambient to about 80° C., and preferably from about 35° C. to about 70° C., and most preferably from about 55° C. to about 65° C., including all ranges subsumed therein. The temperature of the final rinse is usually from about ambient to about 95° C., and preferably, from about 30° C. to about 85° C., and most preferably, from about 40° C. to about 75° C., including all ranges subsumed therein, whereby the dishware being cleaned is typically dipped in and/or sprayed with the dishwashing composition of this invention. The final result of such a method is clean dishware with a glossy finish, whereby starch removal has been enhanced and starch build-up has been prevented, and the dishware dries in about substantially the same time as clean dishware that has not been subjected to the detergent composition of this invention but has been subjected to a commercially available compositions.

As to the dishwashers, for example, that are used with the method of this invention, such dishwashers include those which are made commercially available from manufacturers including KitchenAid, Bendix Appliances, Electrolux, Meiko, Hobart, Winterhalter, Equator Appliance, Frigidaire, Asko USA and the like.

It is noted herein, that the soil removal surfactant described in this invention may be present in or dosed in the detergent wash or the rinse aid or both during the cleaning method. Moreover, the dishware cleaned via this invention (or cleaned via any conventional process) may be pretreated, prior to being subjected to soil, with a pre-coating composition. The pre-coating composition comprises:

(a) a silicon comprising surfactant, or (b) an alpha, omega-alkyl dicarboxylic acid surfactant wherein the alkyl chain of the dicarboxylic acid is functionalized with at least one hydrophilic group, or both.

The pre-coating composition may further comprise water, and typically consists of surfactant, and preferably, consists essentially of water and surfactant.

When water is present, the pre-coating composition typically comprises from about 8.0 ppm to about $9.9\times10^5$ ppm surfactant, and preferably, from about 10 ppm to about 500 ppm surfactant, and most preferably, from about 20 ppm to about 150 ppm surfactant.

The pre-coating composition may be applied to the dishware being cleaned via any art recognized technique. Typically, the dishware is dipped or sprayed with the optional pre-coating composition.

The amount of optional pre-coating composition applied is only limited to the extent that the pre-coating composition coats the surface of the dishware and does not interfere with the dishware's conventional use.

The following examples are provided for illustrative purposes, and are not intended as a restriction on the scope of the invention. Thus, it is obvious that various changes may be made to the specific embodiments of this invention without departing from its spirit. Accordingly, the invention is not to be limited to the precise embodiments shown and described, but only as indicated in the following claims.

EXAMPLE 1

A first vessel was charged with 500 mL of water and 50 g of commercially available crystalline potato starch. The contents were stirred at ambient temperature to produce a potato starch suspension. A second vessel was charged with 5 grams of Remazol brilliant blue dye (commercially available from Aldrich) and 500 mL of water. The contents were stirred at ambient temperature to produce a dye solution. The dye solution was added to the potato starch suspension to produce a starch-dye solution which was subsequently stirred and heated to 50° C. The starch-dye solution was maintained at 50° C. for about 45 minutes, during which 100 grams of sodium sulfate were added in parts (about 4 additions). To the resulting mixture, a solution having 50 mL of water and 5 grams of tri-basic sodium phosphate was added wherein the resulting final mixture was stirred for 75 minutes while maintaining the temperature at 50° C. After stirring, the final mixture was filtered and the filtrate was discarded. The resulting solid was resuspended in water and refiltered. The washing was repeated until the filtrate obtained was colorless. The resulting final solid was washed with methanol to remove any residual water. The resulting washed final solid was about 50 grams of azure starch as described in this invention (crystalline potato starch with dye covalently bonded to its backbone and having a maximal absorbance at 596 nm). This experiment was performed in a manner very similar to the one described in *New Method for the Determination of α-Amylase, Experimentia* 23.805, Rinperknecht, H. Wilding, P., and Berk, J. (1967).

Glass slides (about 25 $cm^2$) were washed, dried and weighed. A vessel was charged with 120 mL of water which was preheated to 80° C. and 2.0 grams of azure starch as prepared above. The resulting mixture was stirred and maintained at 80° C. for about 15 minutes, after which the resulting product was a thick gel. The starch gel was divided into 40 gram portions that were each charged with 120 mg of surfactant (see Table I below for the list of surfactants tested), identical to those used in the superior dishwashing compositions of this invention. The resulting surfactant-gel mixture was then evenly distributed, in 5 mL portions, onto one side of the glass slides with a pipette. The coated slides were dried overnight at ambient temperature, resulting in slides having dry retrograded azure starch gel on one side amounting to about 80–85 milligrams of substance.

About 200 mL of detergent wash (see Table II below for the wash solution formulation) was added to a 250 mL jacketed beaker. The beaker was connected to a water circulating bath and placed on a magnetic stir hot plate. The detergent wash was stirred, via a stir bar, and maintained at a constant temperature of about 62° C.

Three slides having dry retrograded azure starch (as prepared above) were submerged upright in the jacketed beaker with the starch containing sides of the slide facing inward. A compound capable of degrading starch (Termamyl 300L, commercially available from Novo Nordisk) was dosed into the detergent wash in the beaker so that the concentration of starch degrading material was maintained at about 40 ppm. The degradation of azure starch on the slides was monitored by spectrophotometric analysis of the detergent wash at 30 second intervals over a thirty minute time period. As the azure starch degraded, soluble fragments of starch containing dye were liberated into the detergent wash. The colored detergent wash was circulated through a flow cell with a 1 cm path length via a Hewlett Packard pump (No. 89052) set at a flow rate of 50 mL per minute. The pumps inlet tube (about 2 mm) was fitted with a 45 micron frit to prevent the circulation of any insoluble starch fragments into the flow cell. Absorbance was measured at 596 nm using a Hewlett Packard 8453 photodiode array spectrophotometer. The absorbance values increased as the colored detergent wash darkened, indicating that more of the azure starch degraded. All data obtained was analyzed with Hewlett Packard UV-Vis Chemstation software and is set forth in Table III.

TABLE I

| Detergent Composition | Surfactants* |
|---|---|
| 1 | Silwet L-77 |
| 2 | Silwet L-7600 |
| 3 | Silwet L-7602 |
| 4 | Silwet L-7604 |
| 5 | Silwet L-7210 |
| 6 | Aerosol OT-100 |
| 7 | Plurafac LF 221 (alcohol alkoxylates) |

*The surfactants are commercially available or made by the following: Nos. 1–5, Witco Corporation; No. 6, Cytec Industries; No. 7, BASF

TABLE II**

| Detergent Wash | |
|---|---|
| Reagent | Weight Percent |
| Nitrilotriacetic acid, trisodium salt (40%) | 70% |
| Potassium silicate | 12.5% |
| Potassium hydroxide (50%) | 5.6% |
| Sodium sulfite | 2.0% |
| Water | Balance |

**The reagents were added to a mixing vessel and stirred at ambient temperature. Nitrilotriacetic acid at 40% means 40% nitrilotriacetic acid, trisodium salt and 60% water and potassium hydroxide at 50% means 50% potassium hydroxide and 50% water, all percents being by weight based on total weight of the detergent wash.

TABLE III***

| Detergent Composition | Absorbance | % Starch Degradation |
|---|---|---|
| 1 | 0.3100 | 148 |
| 2 | 0.3818 | 183 |
| 3 | 0.3519 | 169 |
| 4 | 0.4173 | 200 |
| 5 | 0.2610 | 125 |
| 6 | 0.3032 | 145 |
| 7 | 0.1725 | 83 |
| No surfactant (control) | 0.2088 | 100 |

***The data above shows that simulated dishwashing compositions (e.g., detergent washes, rinse aids or both) prepared as set forth in this invention unexpectedly result in at least a 25.0% increase in starch degradation when compared to the control.

$$\% \text{ Starch degradation} = A_s/A_I \cdot 100\%$$

wherein $A_s$ is the absorbance at 596 nm of dishwashing composition with surfactant and $A_I$ is the absorbance at 596 nm of the detergent composition without surfactant (the control).

EXAMPLE 2

A mixing vessel was charged with deionized water and a 4:1 calcium:magnesium mixture to produce water having a total hardness of 150 ppm expressed as $CaCO_3$. A jacketed beaker was charged with 100 grams of the hard water, and a water temperature of about 95° C. was maintained. To the water was added a potato starch suspension prepared by adding 15 grams of potato starch (commercially available from Sigma) to 35 mL of water at about 5° C. To 100 grams of the resulting thick gel were added 50 mL of cold (about 5° C.) water. The resulting mixture was blended with a commercially available blender set on liquefy for about 3 minutes, producing the potato starch soil used in the following experiments.

Ceramic tiles (about 25 $cm^2$) were washed with water and dried. Potato starch soil (1 gram per tile), as prepared above, was uniformly applied to the tiles with a brush. The tiles were air dried at room temperature for 15 minutes, then baked at 71° C. for 15 minutes, producing soiled tiles.

A simulated multi-tank dishwashing machine having a wash tank and a rinse tank was set up. The wash tank was maintained at 65° C. and charged with 2.5 g/L of detergent wash described in Table II. The detergent wash was dosed with an amylase enzyme, Termamyl 300L, enough to produce a 40 ppm solution. The detergent wash was also dosed with 0.0375 g/L surfactant (or 0.25 g/L rinse aid having 15% surfactant) (surfactants as in Table IV) to simulate actual dishwashing conditions in a counter flow machine. The rinse tank was charged with the identical surfactant that was dosed into the detergent wash in the form of a 0.0375 g/L water solution at about 70° C. Six (6) soiled tiles (as prepared above) were washed in the detergent wash for 3 minutes, and then rinsed in the rinse tank for 30 seconds. The tiles were then air dried and the entire process was repeated for a total of three cycles (including soiling) to produce washed tiles subjected to dishwashing composition.

The reflectance of the washed tiles was measured using a Gardner Reflectometer (Model No. 2000) set at 460 nm (UV filter). The washed tiles were uniformly submerged in an iodine solution (containing 1.5% by weight potassium iodide and 0.2% by weight iodine, balance water) for a few seconds, gently rinsed with deionized water, and allowed to air dry for about 15 minutes. The reflectance was measured at the center and four corners of each tile and the values from the six tiles were averaged. The starch build-up on the tiles was recorded as a % ΔR (percent change in reflectance) which is determined by taking the difference in the reflectance of the washed tile and a clean tile, divided by the difference in the reflectance of a soiled, unwashed tile and a clean tile. The % ΔR values are set forth in Table IV and a decrease in % ΔR indicates enhanced cleaning results.

% Starch Removal Against Control=$[1-(\% \Delta R_s - \% \Delta R_I)/(\% \Delta R_I)]\times 100\%$, and % $\Delta R_s$ is the percent change in reflectance in the presence of surfactant and % $\Delta R_I$ is the percent change in reflectance without the presence of surfactant (control). ΔR as used in the experiment is defined as the difference between the reflectance measured on a clean dish and the reflectance measured on dishes subject to the conditions in Example 2. $\Delta R_I$ as used herein, is defined to mean the difference between the reflectance measured on a clean dish and the reflectance measured on a washed dish in the absence of surfactant, and $\Delta R_s$, as used herein, is defined to mean the difference between the reflectance measured on a clean dish and the reflectance measured on a washed dish in the presence of surfactant.

TABLE IV

| Surfactant | % ΔR | % Starch Removal**** Against Control |
|---|---|---|
| 1. Silwet L-77 | 9.69 | 130 |
| 2. Silwet L-7602 | 1.90 | 186 |
| 3. $C_8$ $(EO)_8(BO)_2$ | 13.70 | 101 |
| 4. $C_{12-14}(EO)_{10}(BO)_2$ | 21.26 | 47 |
| 5. $C_{16-18}(EO)_{10}(BO)_2$ | 22.90 | 35 |
| 6. Silwet L-7600 | 5.55 | 175 |
| 7. Aersol OT-100 | 8.92 | 160 |
| 8. Control A | 13.88 | 100 |
| 9. Control B | 22.11 | 100 |

****As may be seen from the data above, the superior dishwashing compositions of this invention unexpectedly result in at least 30.0% more starch removal than the control. Surfactants 1–5 were compared to Control A and surfactants 6–7 were compared to Control B.

EXAMPLE 3

Ten ceramic plates were washed with 2.5 g/L detergent wash (similar to the detergent wash described in Table II except that 2.0% Dequest 2000 (50%) sequestrant was also used). The washed plates were pretreated with an aqueous solution of 37.5 ppm Silwet L-7602. The plates were subsequently air dried. A control set of ten plates was washed with the same detergent wash, then air dried. All plates were soiled with two grams of potato starch and allowed to dry overnight. The soiled plates were then washed in a Winterhalter single tank industrial dishwasher with 2.5 g/L detergent solution (with 40ppm Termamyl 300L), followed by a hot water rinse. Two pretreated and two control plates were included in each wash. Five consecutive washes were carried out with the same wash water to mimic conventional warewashing practice. After the five washes, all plates were air dried, then dipped in an iodine indicating solution and visually assessed in terms of residual starch on the plate surface. The averaged residual starch findings are shown in Table V. It is noted that 0.0 is defined to mean no starch present and 5.0 is defined to mean complete coverage with starch. The data in Table V shows that residual starch dramatically decreased on plates that were pre-treated with the surfactants described in this invention. All washing, rinsing and iodine contacting steps described in this Example were similar to those described in Example 2.

TABLE V

| Wash Number | Residual Starch After Pretreatment | Residual Starch No Pretreatment (Control) |
|---|---|---|
| 1 | 0.25 | 0.75 |
| 2 | 0.5 | 1.0 |
| 3 | 0.5 | 1.35 |
| 4 | 0.5 | 1.48 |
| 5 | 0.5 | 1.75 |

EXAMPLE 4

Ninety ceramic plates were washed in 2.5 g/L detergent wash (described in Example 3). After being cleaned, thirty were rinsed (30 sec) with water (deionized at 65° C.) and allowed to air dry. Thirty were rinsed in a 37.5 ppm aqueous solution of Silwet L-7600 and air dried. Thirty were rinsed in a 37.5 ppm aqueous solution of Silwet L-7602 and air dried. All plates were then soiled with 2 g of potato starch and allowed to dry overnight. The plates were washed in a Winterhalter single tank industrial dishwasher using 2.5 g/L detergent with 40 ppm Termamyl 300L (2 minutes). The wash also included the same concentration of Silwet used in the pretreatment step, i.e., no Silwet, 37.5 ppm L-7600 or 37.5 ppm Silwet L-7602. Six plates from each group were included in each wash and five consecutive washes were carried out using the same wash water. The plates were then rinsed with the same solutions used in the pretreatment step.

It is noted that the Silwet placed in the rinse step serves as a pretreatment for the plates in the next wash. The Silwet placed in the wash step simulates a multi-tank industrial dishwasher where the rinse water flows through to the wash tank.

After washing, two plates out of the six in each wash were visually assessed for residual starch buildup by dipping in an iodine solution. The remaining four plates were immediately resoiled with potato starch, dried overnight, and washed in the same manner described above. Two plates were again visually assessed and the remaining two plates in each group were re-soiled and subjected to a third wash the following day.

Table VI summarizes the data for the buildup test, where 0.0 indicates no starch and 5.0 indicates complete coverage with starch. Since the five consecutive washes gave very similar results these values were averaged to give a composite score for each group of plates on each of the three days. All washings, rinsing and iodine contacting steps were done in a manner similar to those described in the examples above.

TABLE VI

Three Day Starch Buildup Test (average over five consecutive washes)

| Day | Starch Residue (Control) | Starch Residue (Silwet L-7600) | Starch Residue Silwet L-7602 |
|---|---|---|---|
| 1 | 0.09 | 0.01 | 0.01 |
| 2 | 0.55 | 0.05 | 0.15 |
| 3 | 1.63 | 0.25 | 0.33 |

As apparent by the data, the plates that were treated with the Silwet materials exhibited substantially lower starch buildup versus the control plates over the three day test.

What is claimed is:

1. A method for preventing starch build-up and removing starchy soil on dishware comprising the steps of:

(a) forming a coating having a silicon comprising surfactant on dishware by contacting the dishware in a dishwasher with a dishwashing composition having the silicon comprising surfactant; and (b) removing the dishware from the dishwasher wherein the coating prevents starch build-up in subsequent uses of the dishware.

2. The method for preventing starch build-up and removing starchy soil on dishware according to claim 1 wherein the silicon comprising surfactant comprises the formula:

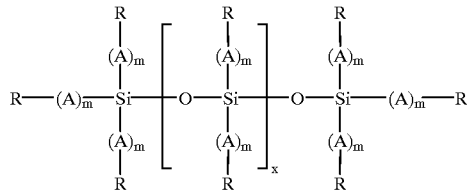

wherein each A is independently a hydrocarbon bridging group; each R is independently a $C_{1-10}$ alkyl, aryl, cationic group, anionic group, polyalkylene oxide; x is an integer from about 1 to about 250; and each m is 0 or 1, with the proviso that at least one R group is hydrophilic and when R is hydrophilic, m is 1.

3. The method for preventing starch build-up and removing starchy soil on dishware according to claim 1, wherein the dishware is at least one member selected from the group consisting of a knives, pots, pans, forks, spoons, glasses, mugs, cups, china, dishes or plastic kitchen utensils.

4. The method for preventing starch build-up and removing starchy soil on dishware according to claim 1 wherein the method is conducted in a domestic dishwashing machine.

5. The method for preventing starch build-up and removing starchy soil on dishware according to claim 1 wherein the method is conducted in an industrial dishwashing machine.

6. The method for preventing starch build-up and removing starchy soil on dishware according to claim 1 wherein the dishwashing composition is a rinse aid.

7. The method for preventing starch build-up and removing starchy soil on dishware according to claim 1 wherein the dishwashing composition is detergent wash.

8. The method for preventing starch build-up and removing starchy soil on dishware according to claim 1 wherein the method further comprises the step of pre-coating the dishware prior to being soiled with a pre-coating composition comprising a silicon comprising surfactant or an alpha, omega-alkyl dicarboxylic acid surfactant wherein the alkyl chain of the dicarboxylic acid is functionalized with at least one hydrophilic group, or both.

9. The method for preventing starch build-up and removing starchy soil on dishware according to claim 8 wherein the pre-coating composition consists essentially of water, and the silicon comprising surfactant.

10. The method for preventing starch build-up and removing starchy soil on dishware according to claim 8 wherein the silicon comprising surfactant has the formula:

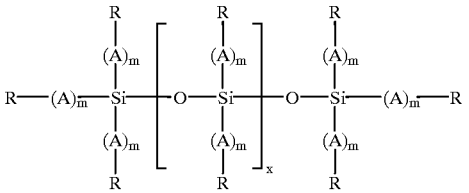

wherein each A is independently a hydrocarbon bridging group; each R is independently a $C_{1-10}$ alkyl, aryl, cationic group, anionic group, polyalkylene oxide; x is an integer from about 1 to about 250; and each m is 0 or 1, with the proviso that at least one R group is hydrophilic and when R is hydrophilic, m is 1.

11. The method for preventing starch build-up and removing starchy soil on dishware according to claim 8 wherein the dishware is sprayed with or dipped in the pre-coating composition.

12. A pre-coating composition for enhancing starchy soil removal on dishware being cleaned, the pre-coating composition comprising: a silicon comprising surfactant.

13. A pre-coating composition according to claim 12 wherein the silicon surfactant comprises the formula:

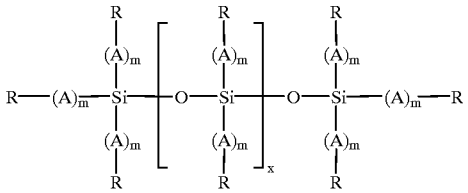

wherein each A is independently a hydrocarbon bridging group; each R is independently a $C_{1-10}$ alkyl, aryl, cationic group, anionic group, polyalkylene oxide; x is an integer from about 1 to about 250; and each m is 0 or 1.

14. A method for pre-coating dishware to prevent starch build-up, the method comprising the steps of:

(a) contacting unsoiled dishware with the pre-coating composition of claim 12; and (b) removing the unsoiled dishware from the pre-coating composition.

* * * * *